US005873742A

United States Patent [19]

McHugh

[11] Patent Number: 5,873,742

[45] Date of Patent: Feb. 23, 1999

[54] BOARD-TO-BOARD CONNECTOR ASSEMBLY

[75] Inventor: Robert G. McHugh, Evergreen, Calif.

[73] Assignee: Hon Hai Precision Ind. Co., Ltd., Taipei Hsien, Taiwan

[21] Appl. No.: 665,417

[22] Filed: Jun. 18, 1996

[51] Int. Cl.[6] ..... H01R 9/09

[52] U.S. Cl. ..... 439/74; 439/247

[58] Field of Search ..... 439/74, 660, 247, 439/248

[56] References Cited

U.S. PATENT DOCUMENTS 5,057,027 10/1991 Yamada et al. ..... 439/74 X 5,277,597 1/1994 Masami et al. ..... 439/660 X 5,639,248 6/1997 Yagi ..... 439/74 OR

*Primary Examiner*—Paula Bradley

*Assistant Examiner*—Daniel Wittels

[57] ABSTRACT

The invention provides a board-to-board interconnection system which can flexibly meet the floating or un-floating requirements. When it is applied to a floating state, the first connector (12) includes an inner unit (16) and outer unit (18) wherein the outer unit (18) is directly mounted on the first board (100) and the inner unit (16) are freely moveable within the outer unit (18), and the second connector (14) is mounted on the second board (102). When it is applied to an un-floating state, the first connector (12') includes only a unit, similar to the inner unit (16), directly mounted on the first board (100) to incorporate the second connector (12) mounted on the second board (102).

10 Claims, 11 Drawing Sheets

BOARD-TO-BOARD CONNECTOR ASSEMBLY

BACKGROUND OF THE INVENTION

1. Field of The Invention

The invention relates to a board-to-board connector assembly arrangement, and particularly to the connection mechanism which may provide floating or self-adjustment function for interconnecting two parallel spaced boards.

2. The Prior Art

The traditional board-to-board connection most of time is generally made by two connectors wherein one is of a plug type mounted on one board and another is of a socket type mounted on another parallel spaced board, both of which mate with each other for mechanical and electrical connection therebetween. The traditional board-to-board connector assembly can be referred to U.S. Pat. Nos. 5,116,247, 5,181,855, 5,277,597, 5,395,250, 5,433,616 and 5,478,248.

As noted, in the recent years, miniaturization is a trend in the computer field which requests tinier dimensional connector to mating with a complementary connector having the similar dimension. Such tiny dimension makes higher precision requirements and tough tolerances in the connector design/manufacturing; otherwise, the mis-aligned plug connector and socket connector will be damaged during their improper mating. Therefore, it is desired to have a floating structure built in either the socket connector or the plug connector which allows adjustable mating between the socket connector and the plug connector even if there is substantially a deviation between the plug connector and the socket connector along their mating region.

Therefore, an object of the invention is to provide a connector assembly with floating mechanism for use with two boards wherein such floating mechanism can absorb lateral deviation between two mating connectors which are respectively mounted on the two corresponding boards, so that the desired reliable connection can be obtained.

Another object of the invention is to provide a connector assembly which is adapted to be easily alternatively arranged to adopt a conventional type, i.e., un-floating type, in the corresponding board-to-board connection. This changeable arrangement provides flexibility during manufacturing for lower the cost.

SUMMARY OF THE INVENTION

According to an aspect of the invention, a connector assembly for interconnecting two parallel spaced board, includes a first plug connector mounted on one board and consisted of an inner unit and an outer unit wherein the inner unit has rigid contacts embedded within the inner housing of the inner unit, and the outer unit has flexible contacts embedded within the outer housing of the outer unit whereby the rigid contacts are engaged with the corresponding flexible contacts, the rigid contacts are adapted to engage the contacts of the second socket connector, and the flexible contacts are adapted to be solderably mounted on one board. The inner housing and the outer housing include means for suspend the inner housing within the outer housing in a vertical direction with somewhat freedom in a lateral direction. The second connector is mounted on another board wherein a portion of the housing thereof is received within the inner housing of the inner unit under the condition that the rigid contact in the inner housing, by means of the floating structure due to the suspension between the inner unit and the outer unit, can be adjustably engaged with the contact of the socket connector even though there is a lateral deviation between the second socket connector and the first plug connector.

Moreover, the inner housing of the inner unit with their rigid contacts therein can be slightly changed in the form in the flexible manufacturing system (FMS) to independently incorporate the second socket connector for performing a traditional un-floating connection therebetween without the outer unit aside.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
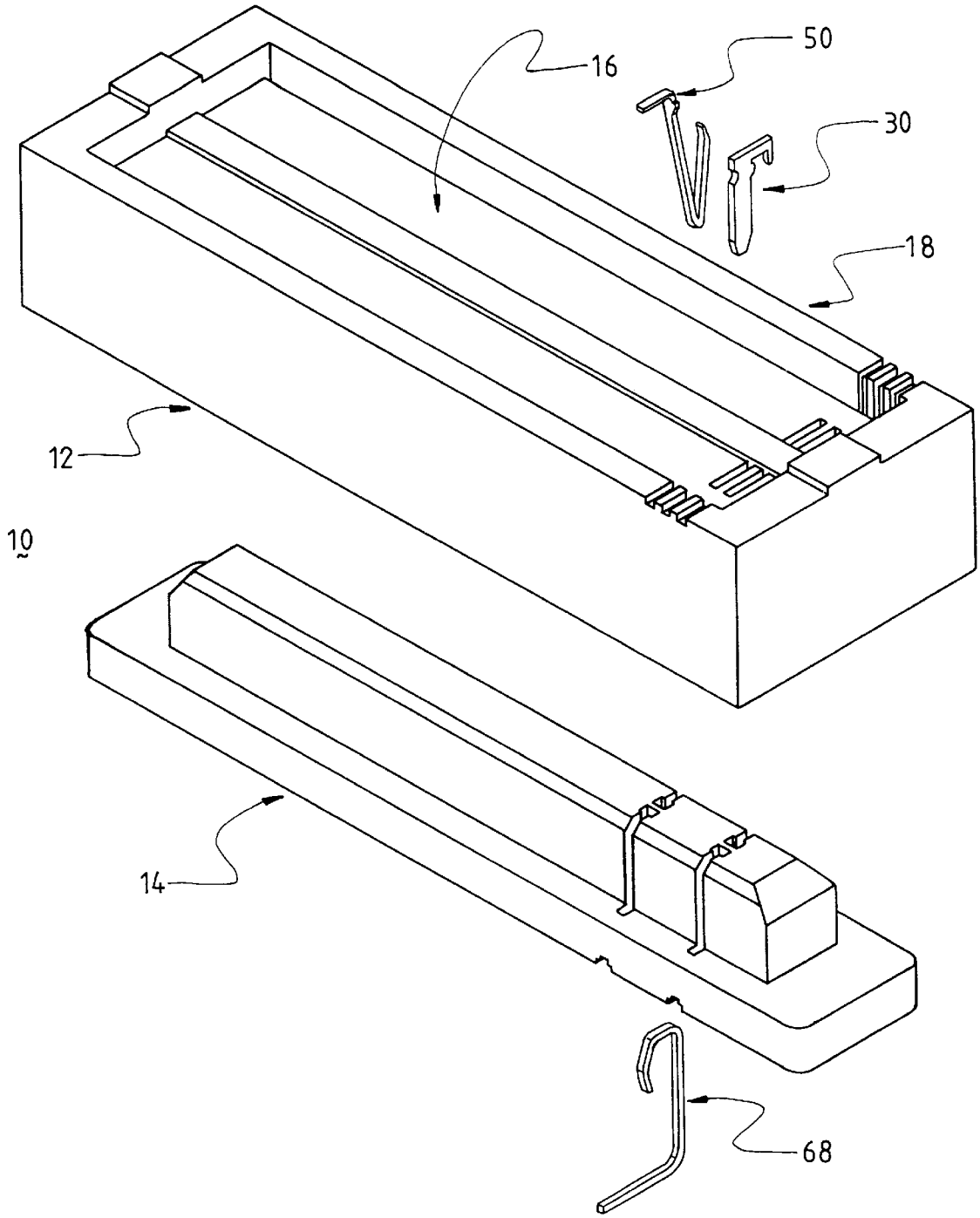
FIG. 1 is an exploded perspective view of a present preferred embodiment of a connector assembly including a first plug connector and a second socket connector for use with board-to-board connection according to the invention wherein the first plug connector is not disassembled.
Figure 8:
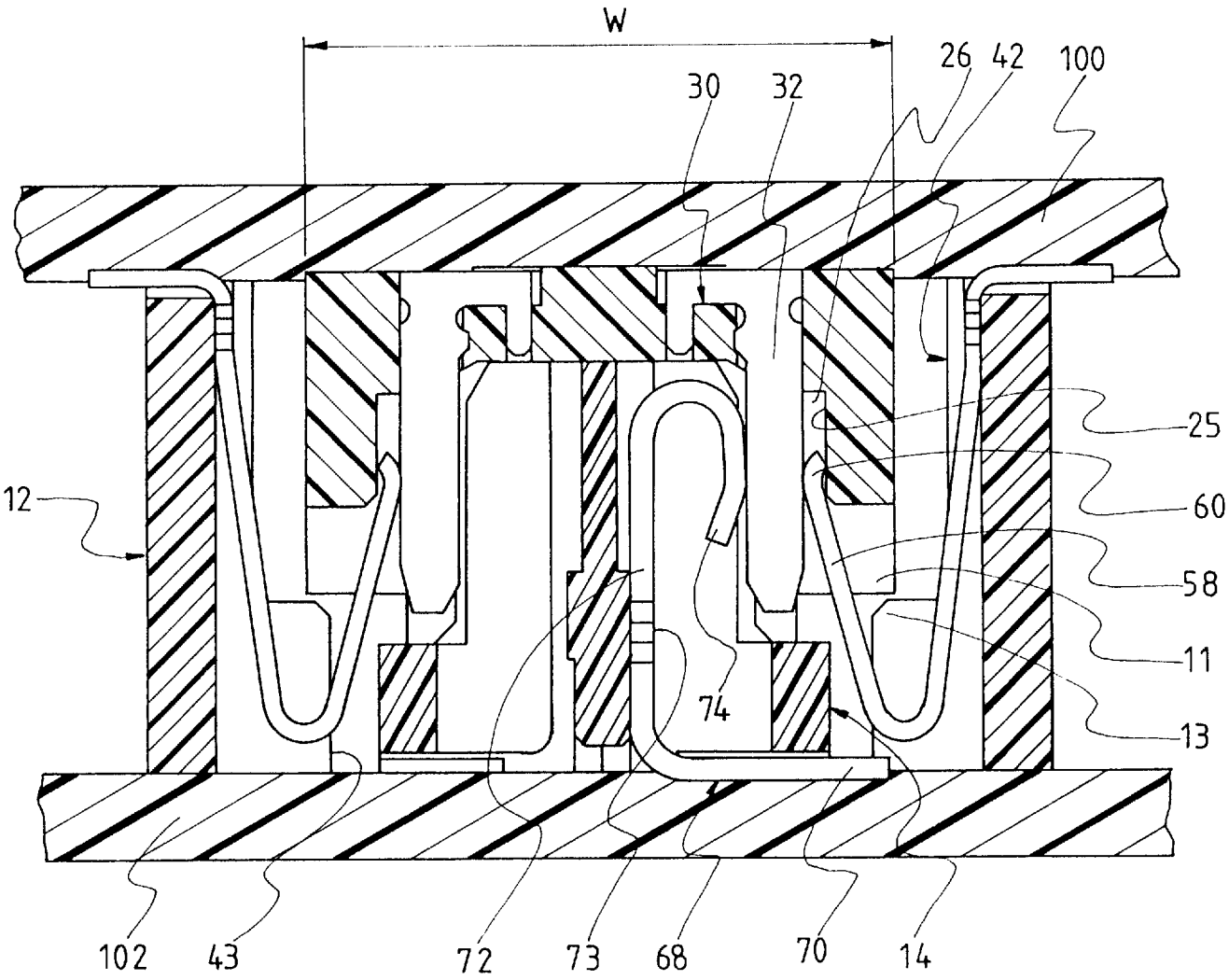
FIG. 8 is a cross-sectional view of the fully assembled first plug connector and second socket connector of FIG. 1.

It will be noted here that for a better understanding, most of like components are designated by like reference numerals throughout the various figures in the embodiments. Attention is directed to FIG. 1 wherein an connector assembly 10 includes a first plug connector 12 and a second socket connector 14 for respectively mounting to a pair of spaced opposite boards 100, 102 as shown in FIG. 8. The first plug connector 12 includes an inner unit 16 and an outer unit 18 wherein the inner unit 16 is freely movably positioned within the outer unit 18.

Figure 2:
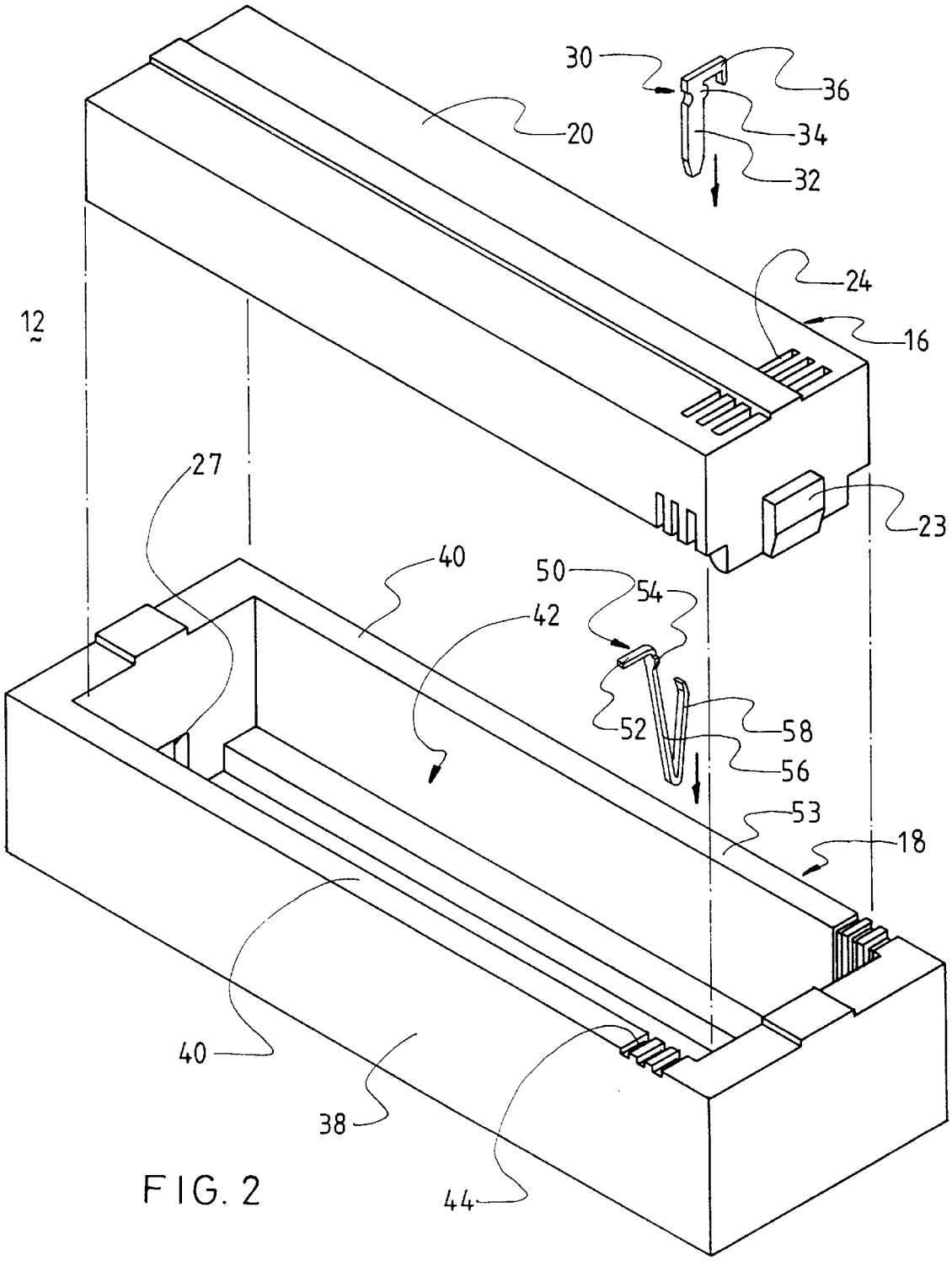
FIG. 2 is an exploded perspective view of the first plug connector of FIG. 1.
Figure 3:
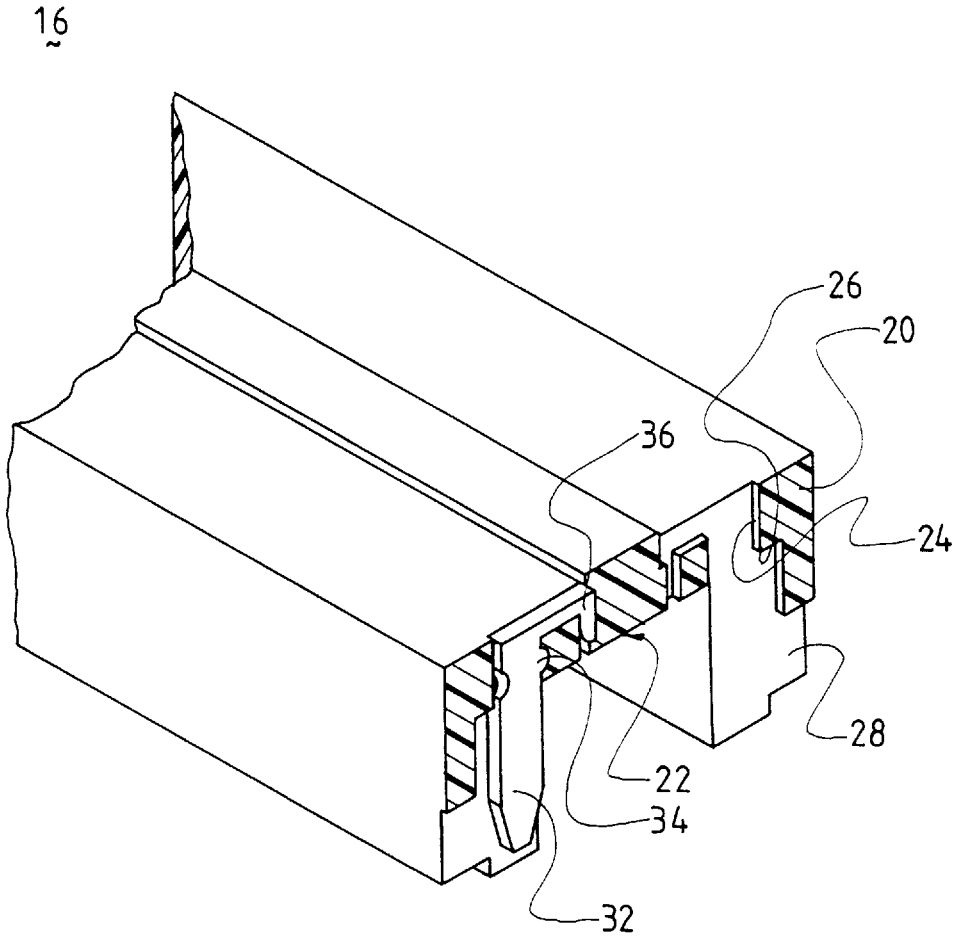
FIG. 3 is a fragmentary cut-away perspective view of the inner unit having therein contacts of the first plug connector of FIG. 1.

Referring to FIGS. 2 and 3, the inner unit 16 includes an insulative elongated housing 20 with a central slot 22 extending along the lengthwise direction, so as to define a U-shaped cross-sectional configuration. Two-row passageways 24 are arranged along the lengthwise direction of the housing 20 wherein each passageway 24 includes a small recess 26, beside the main portion of the cavity 24, which is integrally formed with a large recess 28 directly open to the exterior. A generally L-shaped blanked contact 30 is retainably received within the corresponding passageway 24 with the main body 32 being received within the main portion of the passageway 24 wherein a retention barb 34 is formed adjacent the fixed end of the main body 32, and a retention post 36 is formed spaced from and parallel to the main body 32. Through the retention post 36 and the retention barb 34 of the contact 30, the contacts 30 can be retained within the corresponding passageway 24.

Figure 4:
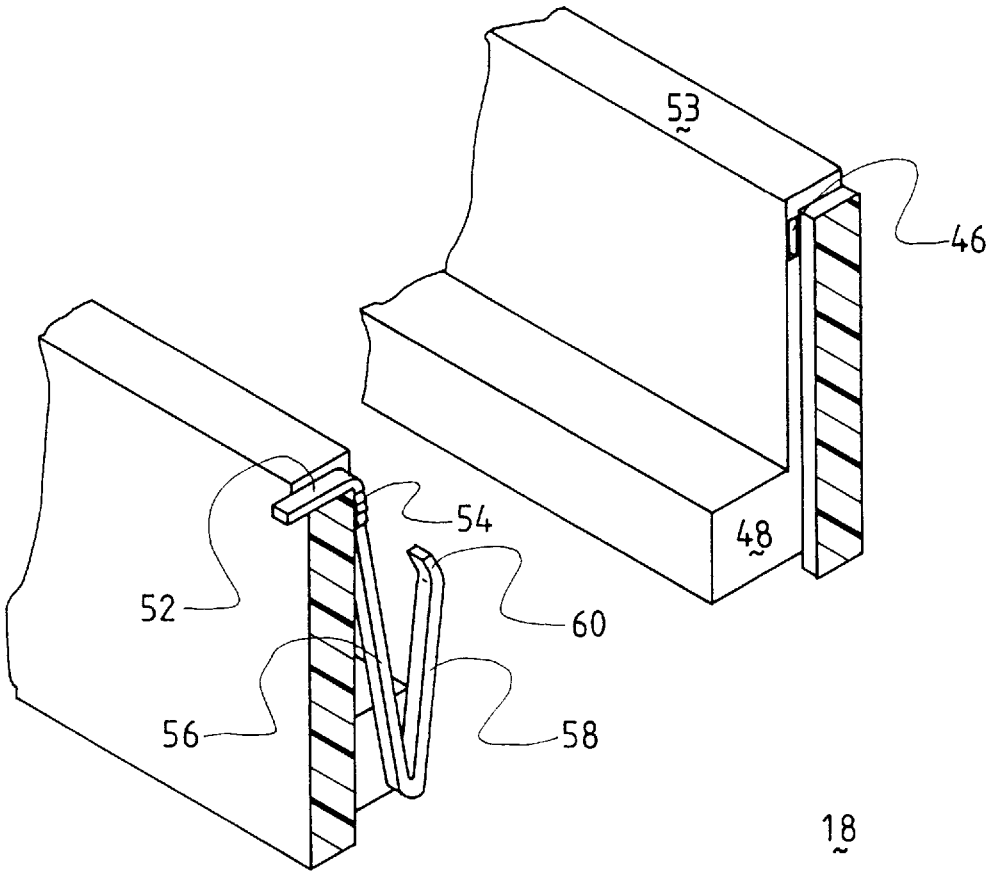
FIG. 4 is a fragmentary cut-away perspective view of the outer unit having therein contacts of the first plug connector of FIG. 1.

Referring to FIGS. 2 and 4, the outer unit 18 includes an insulative elongated housing 38 which is generally of a frame type including four surrounding walls 40 defining a large cavity 42 therein. Two-row passageways 44 are formed along two opposite lengthwise side walls 40 wherein each passageway 44 includes a pair of indents 46 on two opposite interior surfaces 48. A formed contact 50 received within the corresponding passageway 44, includes a surface-mounting section 52 exposed to the external bottom surface 53 of the housing 38, a retention section 54 successively extending from the surface mounting section 52 for interferential engagement with the corresponding indents 46 in the passageway 44, and a bellow type deflectable contacting section 56 extending successively from the retention section 54 wherein the backward portion 58 of the such bellow type contacting section 56 substantially projects into the cavity 42 in the housing 38.

Figure 5:
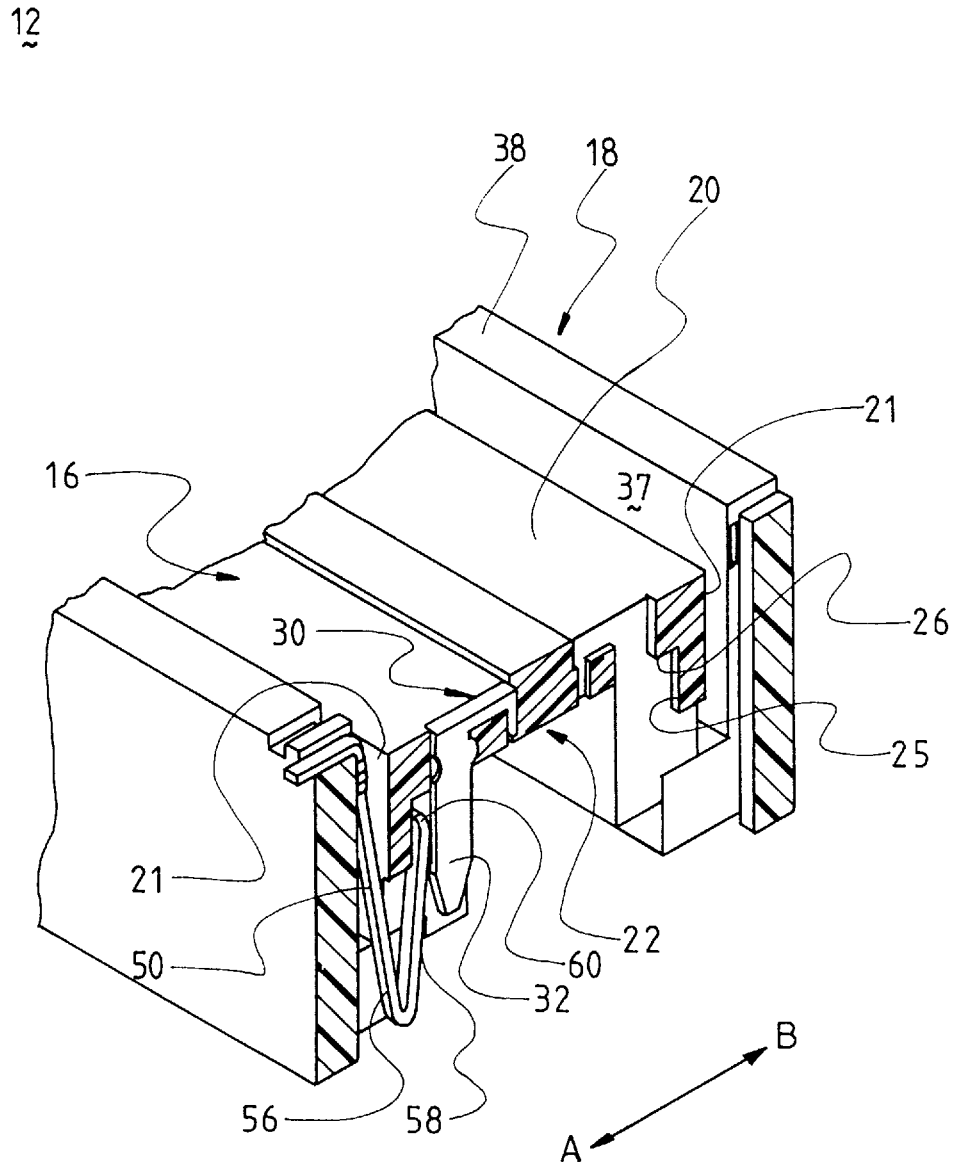
FIG. 5 is a fragmentary cut-away perspective view of the assembled first plug connector of FIG. 1.
Figure 6:
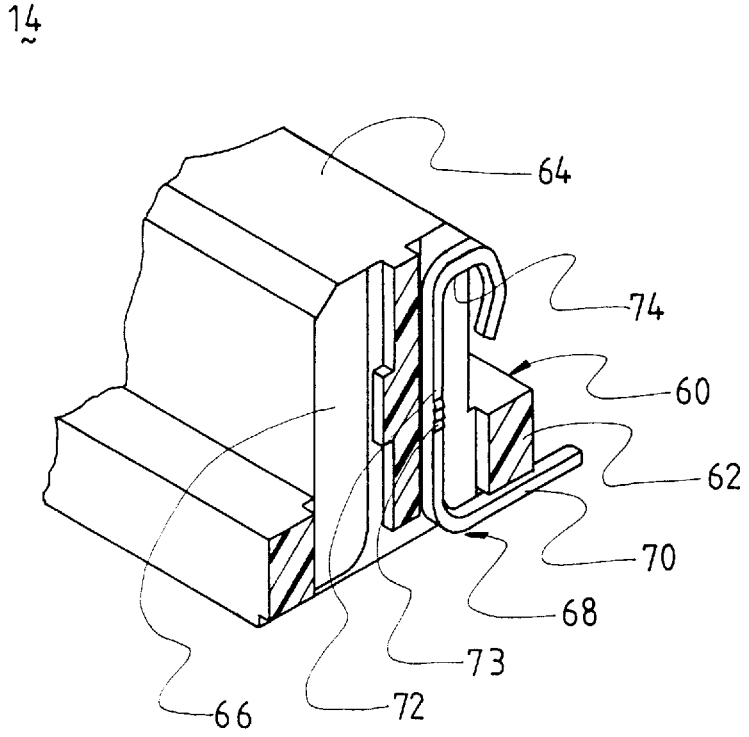
FIG. 6 is a fragmentary cut-away perspective view of the second socket connector of FIG. 1.

It can be seen that referring to FIG. 5, when the inner unit 16 and the outer unit 18 are combined together, the outer unit 18 is loaded unto the inner unit 16 from the top. Each distal end 60 of the backward portion 58 of the contacting section 56 of the contact 50 is designedly received within the recess 26 in the housing 20 of the inner unit 16 and substantially sandwiched between the main body 32 of the contact 30 and the inner surface 25 around the recess 26. Because of such engagement between the contacts 52 of the outer unit 18 and the contacts 30 of the inner unit 16, the inner unit 16 and the outer unit 18 result in a relatively moveable arrangement therebetween in a lateral direction (i.e., arrows A and B in FIG. 5). It can be seen that the outermost surface 21 of the inner unit 16 is sufficiently spaced from the innermost surface 37 of the outer unit 18 whereby the exterior contour of the inner unit 16 is much smaller than the dimension of the cavity 42 in the outer unit 18, and therefore, the inner unit 16 can be freely floating within the cavity 42 of the outer unit 18 in the lateral directions.

Figure 7:
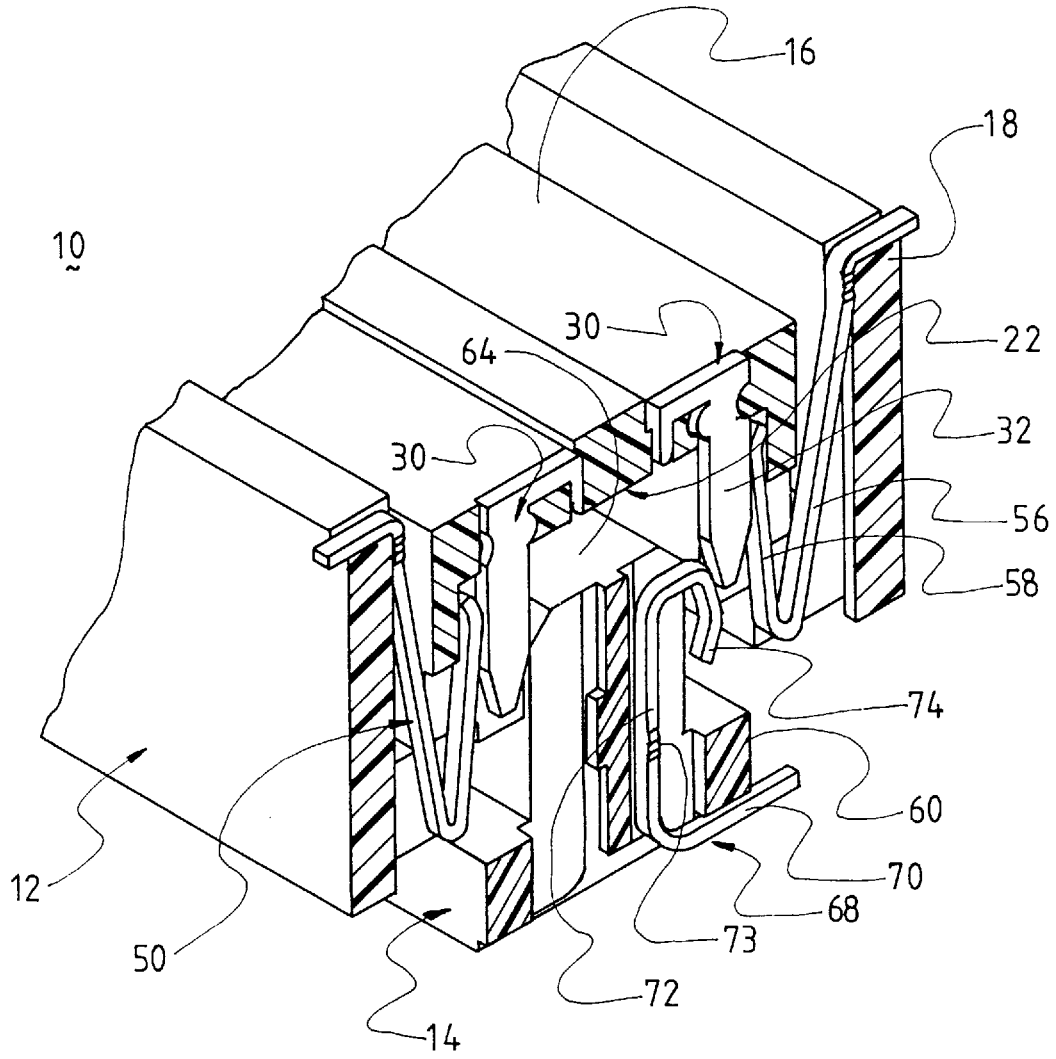
FIG. 7 is a fragmentary cut-away perspective view of the partially assembled first plug connector and the second socket connector of FIG. 1.

It is also contemplated that referring to FIGS. 5, 7 and 8, the abutment of the backward portion 58 of the contact 50 against the housing 20 of the inner unit 16 can provide a proper resistance to prevent the inner unit 16 from further relatively deep reception within the outer unit 18. It is also noted that the width W of the inner unit 16 is substantially larger than the narrowed portion 43 of the cavity 42, so that it is impossible to have the inner unit 16 excessively downwardly protrude out of the outer unit 18 in the vertical direction. In other words, as shown in FIG. 8, the outermost shoulder 11 of the housing 20 of the inner unit 16 closely confronts the innermost shoulder 13 of the housing 38 of the outer unit 18, and that assures the vertical relative positions of the inner unit 16 and the outer unit 18. Furthermore and in contrast, referring to FIG. 2, to prevent the inner unit 16 from being withdrawn from the outer unit 18 from the bottom surface 53 of the outer unit 18, the housing 20 of the inner unit 16 includes a pair of latches 23 formed on two lengthwise ends for engagement with another pair of corresponding recessions 27 formed in the opposite lateral side walls 40. Thus, no withdrawal of the inner unit 16 from the outer unit 18 would occur.

The first connector 12 including the assembled inner unit 26 and the outer unit 18, is adapted to be mounted to a board 100 (FIG. 8) by means that the surface-mounting sections 52 of the contacts 50 of the outer unit 18 are soldered onto the board 100.

Referring to FIGS. 1, 6, 7 and 8, the second connector 14 is a counterpart one to the first connector 12 wherein such connector 14 includes an insulative housing 60 having a base portion 62 and a central raised island portion 64, and two-row passageways 66 along the lengthwise direction thereof extend through the housing 60 in the vertical direction. A contact 68 received within each of passageway 66, includes a surface-mounting section 70, a successive vertical main body 72 with barbs 73 thereon for retainable engagement within the corresponding passageway 66, and a bellow type contacting section 74 at the top, whereby the surface-mounting section 70 can be solderably mounted onto the second board 102 which is spaced from and opposite to the first board 100 (FIG. 8), and the contacting section 74 protrudes out of the central raised island portion 64 the housing 60 for being ready to couple to the contact 30 of the first connector 12.

Therefore, when the first connector 12 with the associated first board 100 is intended to couple to the second connector 14 with the associated second board 102, the raised island portion 64 is directed to the mating slot 22 in the inner unit 16 of the first connector 12, and continuously gradually moved toward and inserted into the innermost interior of the slot 22 until the raised portion 64 of the second connector 14 may be fully embedded within the slot 22 in the first connector 12 and the contacts 68 of the second connector 14 couple to the contacts 30 of the inner unit 16 of the first connector 12.

The feature of the first embodiment of the invention includes the floating structure of the first connector 12, i.e., the laterally moveable inner unit 16 with regard to the outer unit 18, which is fixed onto the first board 102, in the first connector 12, so that the second connector 14, which is fixed onto the second board 102, may easily mated with the first connector 12 and have the contacts 68 of the second connector 14 engage the contacts 30 of the inner unit 16 of the first connector 16. It is because the inner unit 16 may swing laterally for self-adjustment to obtain a position for efficiently having optimal engagement between most of contacts 68, 30 of the second connector 14 and first connector 12. Understandably, in the prior art having the fixed first connector and the fixed complementary second connector, the high precision is required; otherwise, the tiny contacts can not be efficiently engage with each other because of the poor normal force of such contacts' engagement or because of the contact crash due to an excessive normal force of such contacts' engagement. In conclusion, the floating mechanism of the first connector 12 can absorb the centerline deviation between the first connector 12 and the second connector 14.

It can be seen that in this first embodiment, the floating effect is provided by the deflectable contact sections 56 of the contacts 50 of the outer unit 18 and by the huge cavity 42 of the outer unit 18, while the electrical and mechanical engagement between the first connector 12 and the second connector 14 is operated by the inner unit 16 and its own contacts 30 with the second connector 14, wherein the outer unit 18 of the first connector 12 and the second connector 14 are solderably mounted onto the opposite parallel spaced boards 100, 102. Because the inner unit 16 is protectively embedded within the outer unit 18, the exterior impact around the outer unit 18 may not influence the inner unit 16, thus avoiding jeopardizing the inside engagement between the inner unit 16 and the second connector 14.

Figure 9:
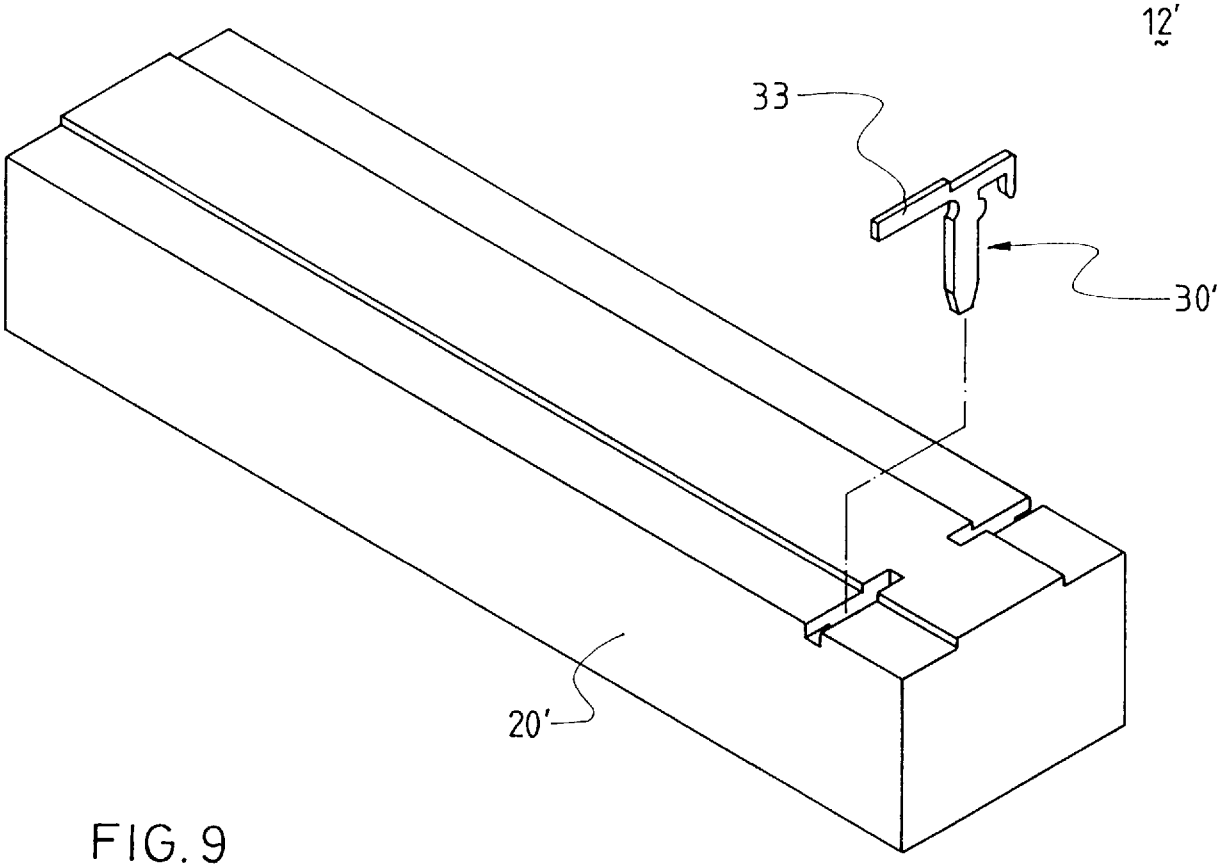
FIG. 9 is a perspective view of a un-floating type first plug connector.
Figure 10:
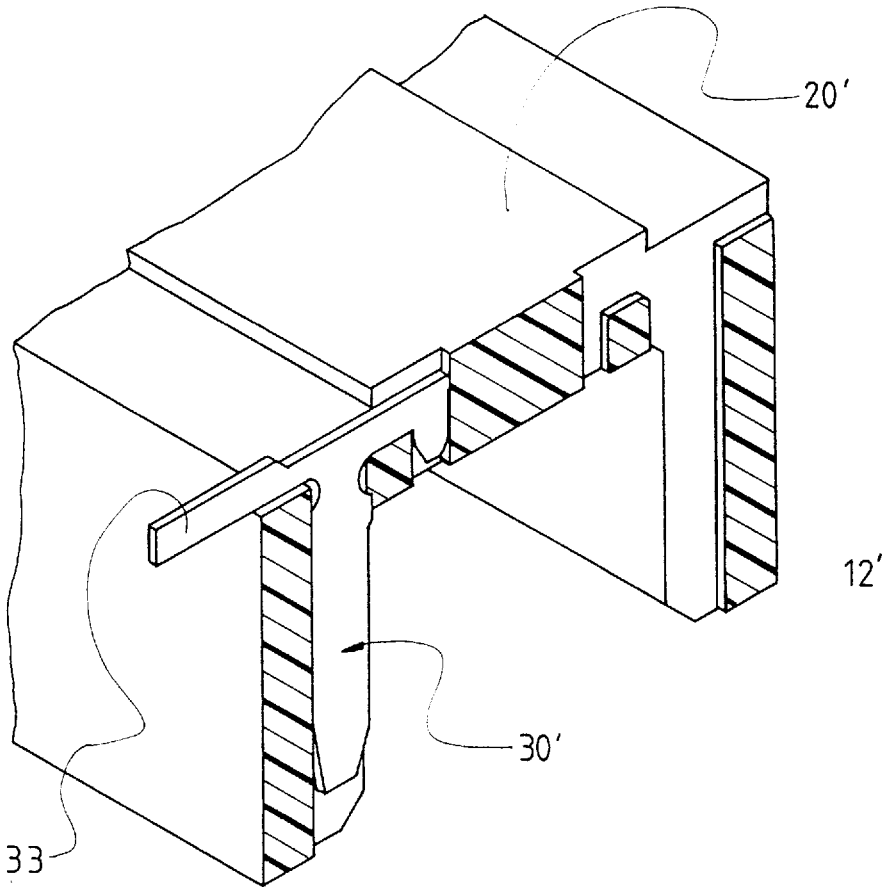
FIG. 10 is a fragmentary cut-away perspective view of the plug connector of FIG. 10.
Figure 11:
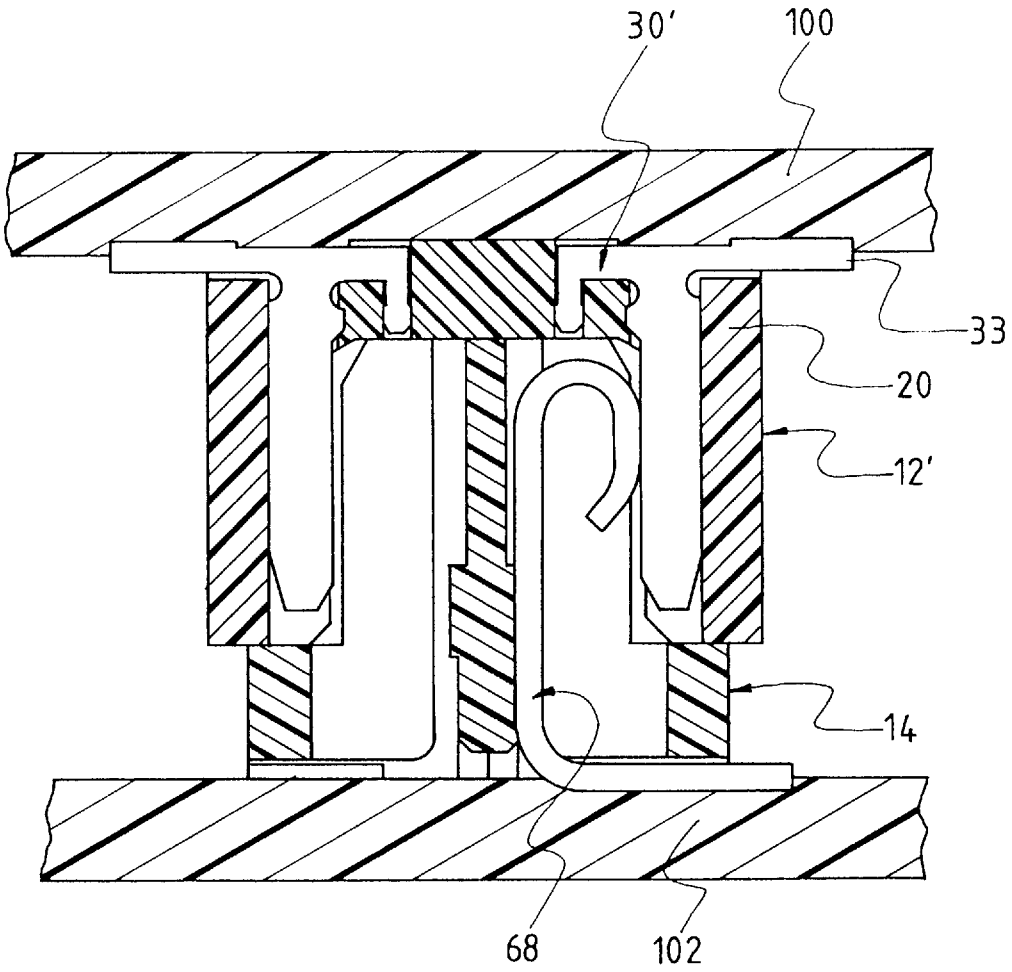
FIG. 11 is a cross-sectional view of the fully assembled first plug connector of FIG. 10 and second socket connector of FIG. 1.

FIGS. 9–11 show another embodiment of the invention which belongs to the traditional un-floating type connection. In this embodiment, the first connector 12 only includes one housing 20' instead of two-piece floating design including the inner unit 16 and the outer unit 18 in the first embodiment, and the single housing 20' is somewhat similar to the housing 20 of the inner unit 16 in the first embodiment except that there is no shoulder or step formed thereof in comparison with the first embodiment having the shoulder 11 of the inner unit 16 for confrontation with the corresponding shoulder 13 of the outer unit 18. Another difference to the first embodiment is that the contact 30' in the housing 20' further includes a soldering section 33 extending horizontally opposite to the post 36 for directly mounting to the first board 100 in place of the surface-mounting section 52 of the contact 50 of the outer unit 18 in the first embodiment. Via a flexible manufacturing system to implement such minor differences with regard to the first embodiment, an un-floating type connection can be made by adopting the same second socket connector 14. Therefore, in the present invention, the arrangement of designing the first connector 12 or 12' and the second connector 14 allows easy alternative manufacturing, by switching between the floating type assembly and the un-floating type assembly, to meet the different applications required by different level customers. This flexibility provides the manufacturer with competition advantage including sharing the molds for most parts when fabrication of both floating and un-floating type connector assemblies, thus lowering the cost.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to he included within the scope of the following claims.

We claim:

1. A connector assembly for connecting two boards, comprising:

a first connector including an inner unit and an outer unit;

said inner unit including an insulative first housing defining a central slot therein along its lengthwise direction;

at least one row of first contacts positioned in the first housing along said lengthwise direction;

said outer unit including an insulative second housing directly mounted on a first board, and defining a relative large cavity for allowing the inner unit to be freely laterally movably received therein;

at least one row of second contacts positioned within the second housing supportably engaged with the corresponding first contacts, respectively, so that the inner unit with its own first contacts can be floating in said cavity with regard to the outer unit; and a second connector directly mounted on a second board, said second connector including a third housing having a raised portion with at least one row of third contacts therein for being receivably positioned within the slot in the inner unit, wherein the third contacts and the first contacts can be properly and efficiently engaged with each other by means of self-adjustment of the first housing of the inner unit of the first connector with regard to the third housing of the second connector.

2. The connector assembly as described in claim 1, wherein each of said second contact includes a deflectable contacting section with a distal end projecting into a corresponding passageway which receives the first contact therein.

3. The connector assembly as described in claim 2, wherein said distal end of the contacting section of the second contact is substantially sandwiched between a main body of the first contact and the first housing of the inner unit.

4. The connector assembly as described in claim 1, wherein the inner unit of the first connector includes at least a latch on a lengthwise end for engagement with a corresponding recession formed in a lateral side wall of the second housing of the outer unit of the first connector, so that the inner unit can not be withdrawn from the outer unit from a bottom surface of the outer unit.

5. The connector assembly as described in claim 1, wherein said first housing of the inner unit includes a first shoulder spatially confronting a second shoulder of the second housing of the outer unit for assuring a proper combination of the inner unit and the outer unit in a vertical direction.

6. The connector assembly as described in claim 1, wherein a main body of each of the first contacts in the first housing of the inner unit has two sides which are respectively engaged with a flexible contacting section of the second contact in the second housing of the outer unit and a flexible contacting section of the third contact in the third housing of the second connector.

7. An arrangement of interconnecting two spaced boards, comprising: a first connector including an inner unit and an outer unit, said outer unit being fixed to the first board and said inner unit being freely moveable with regard to the outer unit in a lateral direction by means that rigid first contacts of the inner unit are supportably engaged with deflectable second contacts of the outer unit, a second connector fixed to a second board wherein flexible third contacts of the second connector can be properly engaged with the rigid first contacts of the inner unit of the first connector by a self-adjustable lateral movement of the inner unit of the first connector relative to the outer unit, whereby signal transmission can be implemented from the second board to the first board by a path from the third contacts of the second connector, through the first contacts of the inner unit, and to the second contacts of the outer unit of the first connector.

8. A connector assembly for interconnecting two spaced boards, comprising a first housing and a second housing mounted on one of said two boards under the condition that the first housing can be somewhat freely moveable with regard to the second housing in a lateral direction, a third housing mounted on another board of said two boards, wherein said third housing is dimensioned to be suitable to mate with the first housing, whereby even if there is a lateral deviation in true mutual mating positions of the first housing and the third housing, the first housing can be properly coupled to the third housing by means of its swinging self-adjustment within the second housing and with regard to the third housing.

9. The connector assembly as described in claim 8, wherein said first housing is supportably moveable with regard to the second housing by a plurality of deflectable contacts received in the second housing.

10. A flexible board-to-board connection system for use in floating situations, comprising:

a first connector mounted on a first board, said first connector including a first housing defining a central slot and a plurality of rigid first contacts on two sides thereof; and a second connector mounted on a second board opposite to the first board, said second connector including only a single housing defining a central raised island portion and a plurality of deflectable second contacts on two sides thereof; wherein said central raised island portion of the second connector can be snugly received within the central slot of the first connector, and wherein the first connector further includes a second housing attachably enclosing said first housing and said first housing can be freely moveable or floatable with regard to the second housing, whereby said first connector and said second connector are in a floating mating manner.

* * * * *